US007469856B1

(12) United States Patent
Tsai

(10) Patent No.: US 7,469,856 B1
(45) Date of Patent: Dec. 30, 2008

(54) TISSUE PAPER WINDING AND CUTTING MACHINE WITH PRE-WINDING ROLLER

(75) Inventor: Tung-I Tsai, Gueishan Shiang (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 0 days.

(21) Appl. No.: 12/007,710

(22) Filed: Jan. 15, 2008

(30) Foreign Application Priority Data

Sep. 4, 2007 (TW) ..... 96132909 A

(51) Int. Cl.
*B65H 19/28* (2006.01)

(52) U.S. Cl. ..... 242/532.3; 242/533.1; 242/542.1

(58) Field of Classification Search ..... 242/532.3, 242/533.1, 542.1, 542.4
See application file for complete search history.

(56) References Cited

U.S. PATENT DOCUMENTS 5,137,225 A * 8/1992 Biagiotti ..... 242/521
5,653,401 A * 8/1997 Biagiotti ..... 242/532.3
5,690,296 A * 11/1997 Biagiotti ..... 242/521
5,853,140 A * 12/1998 Biagiotti ..... 242/534
6,422,501 B1 * 7/2002 Hertel et al. ..... 242/532.3
6,752,344 B1 * 6/2004 Biagiotti ..... 242/521
6,945,491 B2 * 9/2005 Gambini ..... 242/521

* cited by examiner

*Primary Examiner*—Sang Kim
(74) *Attorney, Agent, or Firm*—Rosenberg, Klein & Lee

(57) ABSTRACT

A tissue paper winding and cutting machine includes a first winding roller, at least one core support plate arranged near the first winding roller to form a channel between them, and a pre-winding roller arranged near and below the first winding roller with a circumferential surface facing toward the first winding roller and protruding into the channel to form a narrowed passage in the channel. The pre-winding roller rotates about a shaft thereof in a direction opposite to a predetermined moving direction of a tissue paper to be wound around cores, and at a rotation speed slower than that of the first winding roller. With the rotation speed difference between the pre-winding roller and the first winding roller, a core moved into the channel is temporarily held at the narrowed passage, so that the tissue paper fed into the channel is wound around the core before being pulled broken.

5 Claims, 8 Drawing Sheets

TISSUE PAPER WINDING AND CUTTING MACHINE WITH PRE-WINDING ROLLER

FIELD OF THE INVENTION

The present invention relates to a tissue paper winding machine, and more particularly to a tissue paper winding and cutting machine with a pre-winding roller.

BACKGROUND OF THE INVENTION

In a conventional tissue paper winding mechanism, a core is generally sent by a conveyer to a first winding roller and pushed by a push plate into a curved channel to a winding nip, at where a tissue paper is wound around the core to form a paper log, such as a rolled toilet tissue. When the paper log is about to complete, the tissue paper is either pulled broken by a rotation speed difference between the first winding roller and a rotating device or cut by a cutter.

U.S. Pat. No. 6,877,689 discloses a rewinder apparatus and method. The rewinder apparatus disclosed in U.S. Pat. No. 6,877,689 has a first winding roller that conveys and supports a web, a curved core support plate for receiving and guiding cores adjacent to the first winding roller, and a web separator adjacent to the first winding roller. The web is wound in a winding zone located between the first winding roller, a second winding roller, and a rider roller of the rewinder apparatus. The web separator includes a plurality of rotary fingers. Since the web separator is in contact with the web at a rotating velocity at least equal to a moving speed of the web, the web is effectively separated upstream of the web separator, between the core and the web separator.

However, in a tissue paper winding mechanism using the rotation speed difference between the first winding roller and a rotating device to separate the tissue paper, a control unit is required to control the rotation of the rotating device; and in a tissue paper winding mechanism using a cutter to cut the tissue paper, a stroke and timing control device is required to control the actuation of the cutter.

In either type of the above-described tissue paper winding mechanisms, the tissue paper must be cut before being wound around the core. The conventional tissue paper winding mechanisms do not allow the tissue paper to be wound around the core before being cut.

Moreover, in the case of a tissue paper made of a highly tough material, the speed difference between the rotating device and the first winding roller must be large enough to pull apart the tissue paper.

SUMMARY OF THE INVENTION

It is therefore a primary object of the present invention to provide a tissue paper winding and cutting machine with pre-winding roller, so that the tissue paper may be cut through the use of a pre-winding roller to save any other cutter or stroke and timing control device.

Another object of the present invention is to provide a tissue paper winding machine with a pre-winding roller, so that a tissue paper may be pre-wound around a core via the pre-winding roller before being pulled broken.

A further object of the present invention is to provide a tissue paper cutting machine with pre-winding roller, so that a tissue paper made of a highly tough material can still be pulled broken.

To achieve the above and other objects, the tissue paper winding and cutting machine with pre-winding roller according to the present invention includes a first winding roller; at least one core support plate arranged in a vicinity of the first winding roller. A channel having a loading end and an output end is formed between the first winding roller and the at least one core support plate, allowing a long strip of tissue paper to pass through the loading end to attach to a lower half circumferential surface of the first winding roller and be wound in a predetermined direction around a first core in a winding area. A pre-winding roller is arranged below and in the vicinity of the first winding roller with a circumferential surface of the pre-winding roller facing toward the first winding roller and protrudes into the channel formed between the first winding roller and the at least one core support plate, so that a narrowed passage is formed in the channel between the first winding roller and the protruded circumferential surface of the pre-winding roller. The pre-winding roller has a shaft, about which the pre-winding roller is rotated in a direction opposite to the predetermined moving direction of the tissue paper at a rotation speed slower than that of the first winding roller. When a second core having a length of glue applied thereto is moved from the loading end into the channel and rolls to the narrowed passage in the channel, the second core is temporarily held at the narrowed passage due to a difference between the rotation speeds of the first winding roller and the pre-winding roller, contacting the tissue paper which is attached to the glue on the second core and winds around the circumferential surface of the second core while being clamped by and between the first winding roller and the pre-winding roller. The tissue paper located between the first core and the second core is pulled broken by a pulling force produced by a rolled tissue wound around the first core that keeps rotating while the second core is held at the narrowed passage.

With the tissue paper winding and cutting machine of the present invention, the tissue paper can be pulled broken simply by a pre-winding roller rotating in a direction opposite to the predetermined moving direction of the tissue paper without the need of an additional control unit for controlling the rotation speed of a rotating device or the actuation of a cutter. Moreover, by rotating the pre-winding roller at a rotation speed slower than that of the first winding roller, the tissue paper may be pre-wound around a core before being pulled broken. With the provision of the narrowed passage in the channel between the first winding roller and the core support plates, the core in the channel with the tissue paper pre-wound therearound may be firmly clamped by and between the first winding roller and the pre-winding roller to enable the pulling broken of a highly tough tissue paper without the risk of failing to break the tissue paper as would happen in the prior art.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
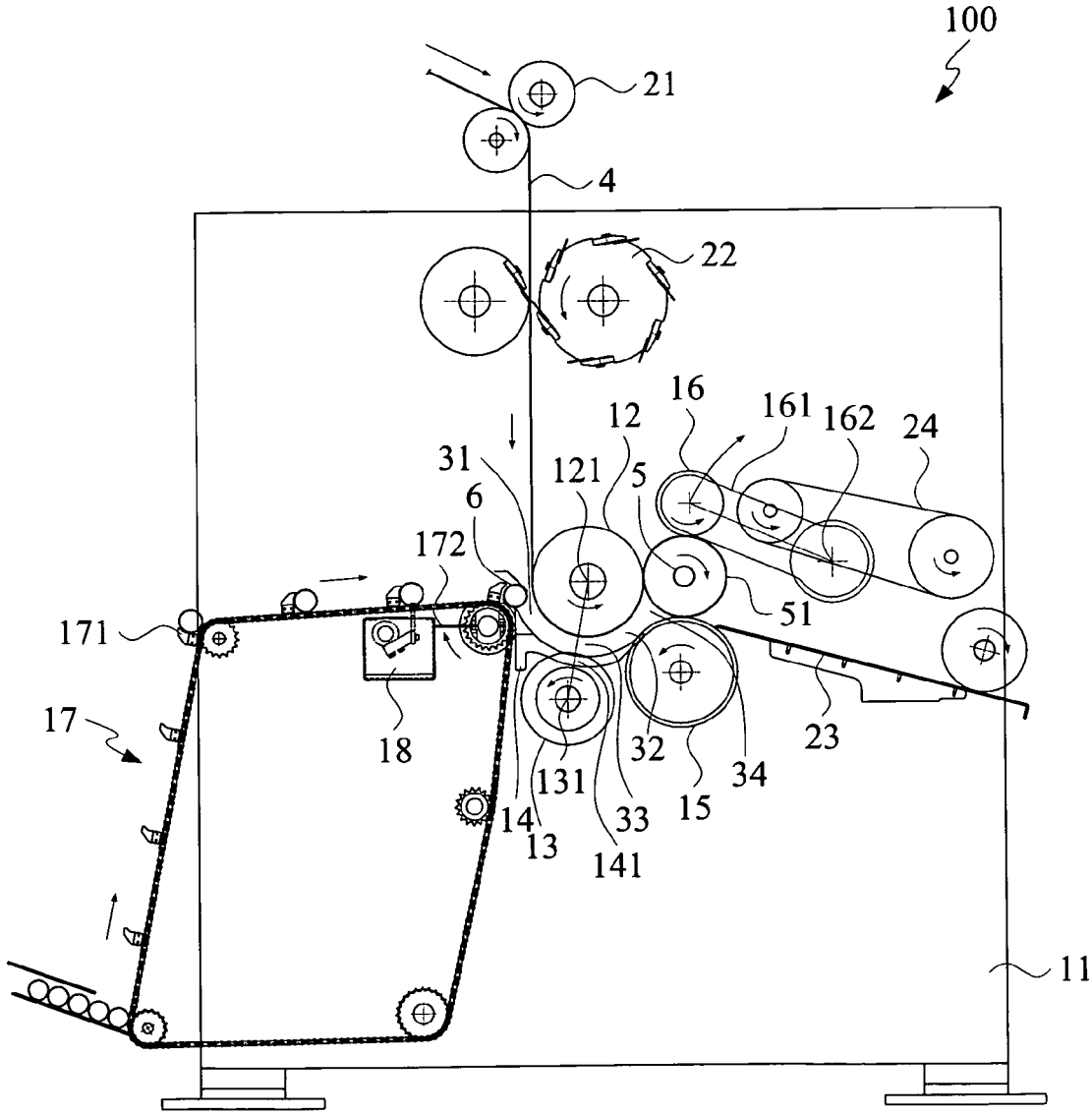
FIG. 1 is a side view of a tissue paper winding and cutting machine with pre-winding roller according to an embodiment of the present invention.

Please refer to FIG. 1 that is a side view of a tissue paper winding and cutting machine with pre-winding roller according to an embodiment of the present invention. The tissue paper winding and cutting machine is generally denoted with a reference numeral 100, and includes a machine frame 11, a first winding roller 12, a pre-winding roller 13, a plurality of core support plates 14 (only one is seen in the side view), a second winding roller 15, a rider roller 16, a conveyer 17, a gluing unit 18, a pair of feed rollers 21, a perforation roller 22, a chute 23, and a belt 24.

Figure 2:
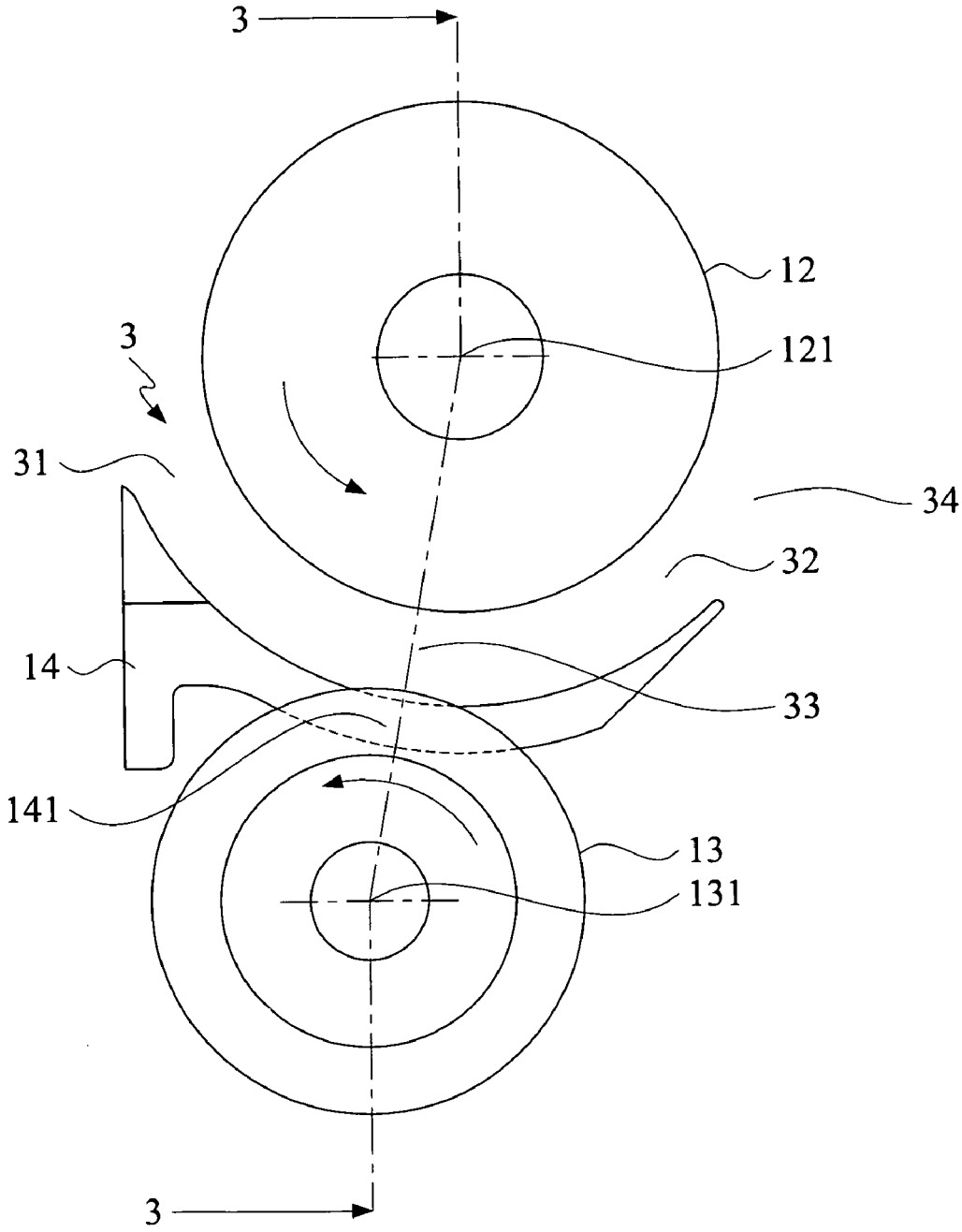
FIG. 2 is an enlarged fragmentary side view showing the spatial arrangement of a pre-winding roller, a first winding roller, and a plurality of core support plates of the tissue paper winding and cutting machine of the present invention.
Figure 3:
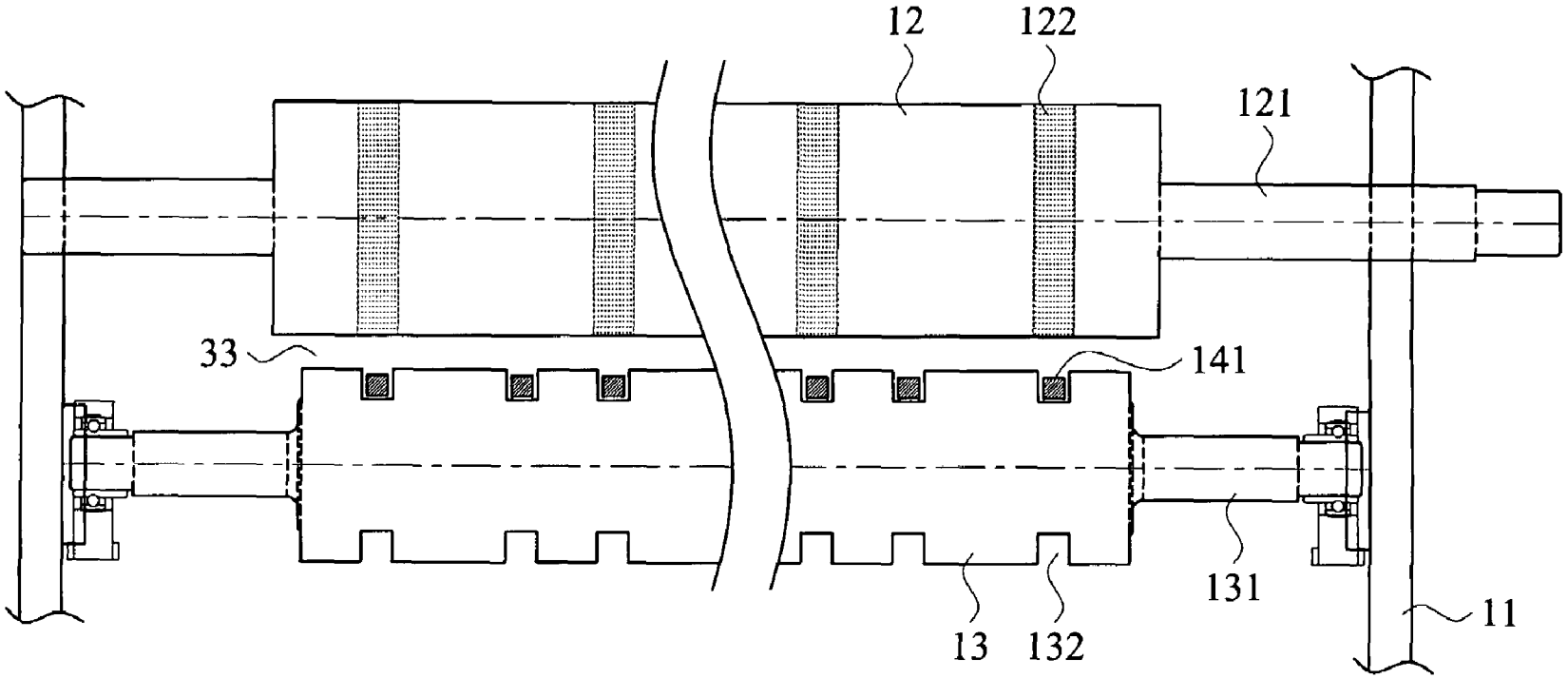
FIG. 3 is a cross sectional view taken along line 3-3 of FIG. 2.

Please also refer to FIGS. 2 and 3 at the same time. The first winding roller 12 is mounted on the machine frame 11 via a shaft 121, and is formed on a circumferential surface thereof with a plurality of axially spaced rough areas 122.

The pre-winding roller 13 is arranged below and in a vicinity of the first winding roller 12 and has a shaft 131. The pre-winding roller 13 is mounted on the machine frame 11 via the shaft 131, and is formed on a circumferential surface thereof with a plurality of axially spaced annular grooves 132. The core support plates 14 are arranged below and in the vicinity of the first winding roller 12 and connected to the machine frame 11 via a beam (not shown), such that the core support plates 14 respectively have a middle section 141 received in a corresponding one of the annular grooves 132 on the pre-winding roller 13, and a channel 3 having a loading end 31 and an output end 32 is formed between the core support plates 14 and the first winding roller 12. An area on a circumferential surface of the pre-winding roller 13 facing toward a lower side of the first winding roller 12 is protruded into the channel 3 formed between the core support plates 14 and the first winding roller 12, so that a narrowed passage 33 is formed in the channel 3 between the first winding roller 12 and the protruded circumferential surface of the pre-winding roller 13.

A winding area 34 is located between the first winding roller 12, the second winding roller 15, and the rider roller 16, where is close to the output end 32 of the channel 3. A tissue paper 4 having a predetermined thickness and width is fed to the tissue paper winding and cutting machine 100 via the feed rollers 21, and is moved through the perforation roller 22, which forms a line of perforations across the tissue paper 4 at predetermined fixed intervals. Then, the perforated tissue paper 4 is moved through the loading end 31 to bear against a lower circumferential surface of the first winding roller 12, and is wound in a predetermined direction around a first core 5 located in the winding area 34 to thereby form in the winding area 34 a rolled tissue 51 having a predetermined diameter, such as a roll of toilet paper. The pre-winding roller 13 is rotated about the shaft 131 in a direction opposite to the predetermined moving direction of the tissue paper 4, and at a rotation speed slower than that of the first winding roller 12.

Figure 4:
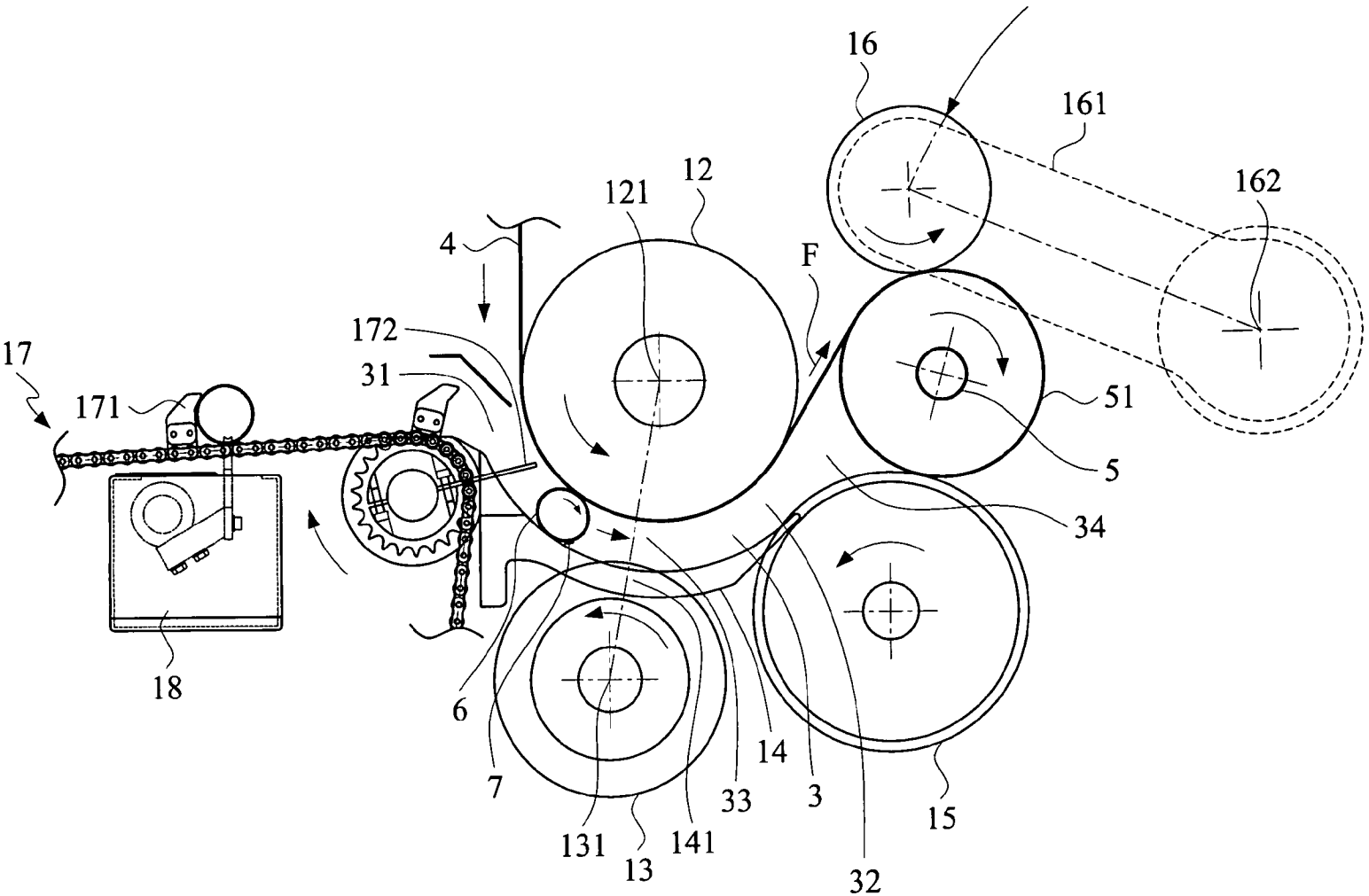
FIG. 4 shows that a second core is moving along a channel between the first winding roller and the core support plates of the tissue paper winding and cutting machine.

Please refer to FIG. 4. The conveyer 17 includes a plurality of carriers 171 and a push plate 172. The gluing unit 18 is arranged at a predetermined position near the conveyer 17. When a plurality of cores are carried by the carriers 171 to sequentially pass through the gluing unit 18, an amount of glue is applied by the gluing unit 18 onto an outer circumferential surface of each of the cores. When a second core 6 is carried by one of the carriers 171 of the conveyer 17 to the loading end 31, the push plate 172 is automatically turned to push the second core 6 into the channel 3. At this point, the second core 6 is in contact with and driven by the first winding roller 12 to roll forward. It is also noted that the second core 6 has passed the gluing unit 18 before being delivered to the loading end 31, and therefore has a length of initial glue 7 applied thereto.

Figure 5:
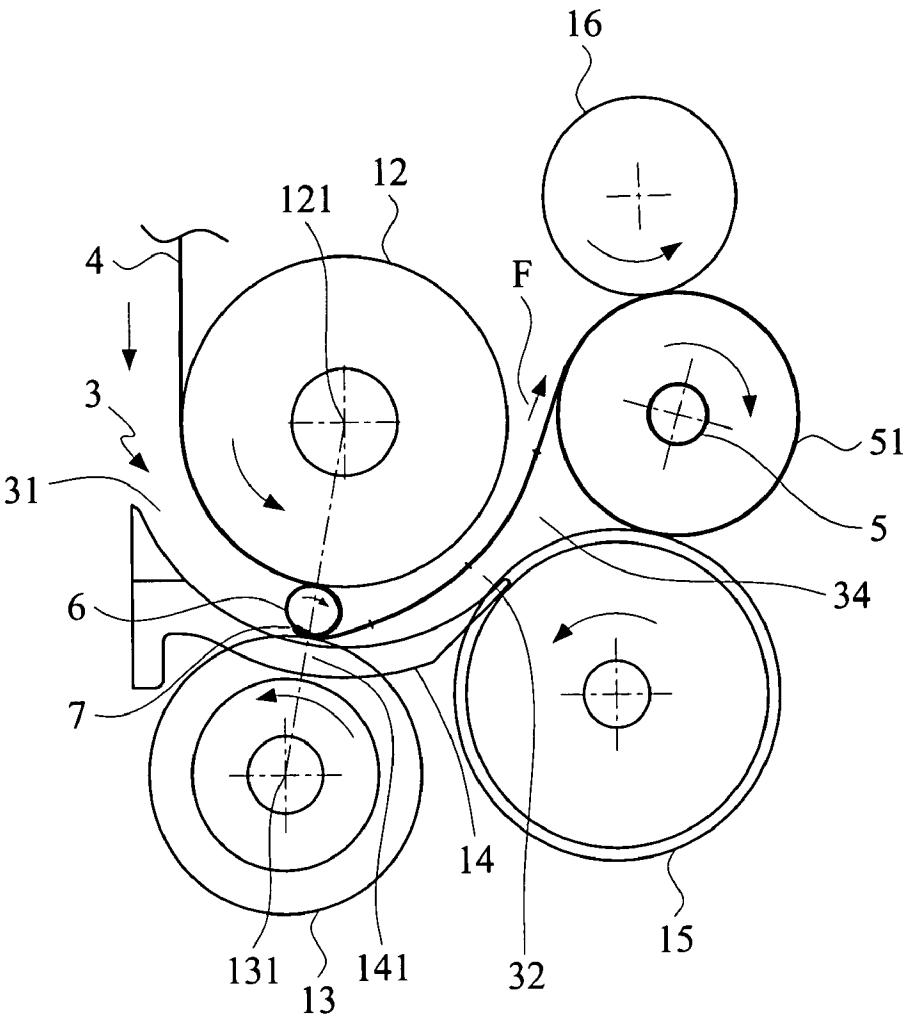
FIG. 5 shows that the second core rolls to a narrowed passage formed between the first winding roller and a circumferential surface of the pre-winding roller protruded into the channel, and starts winding tissue paper therearound.
Figure 6:
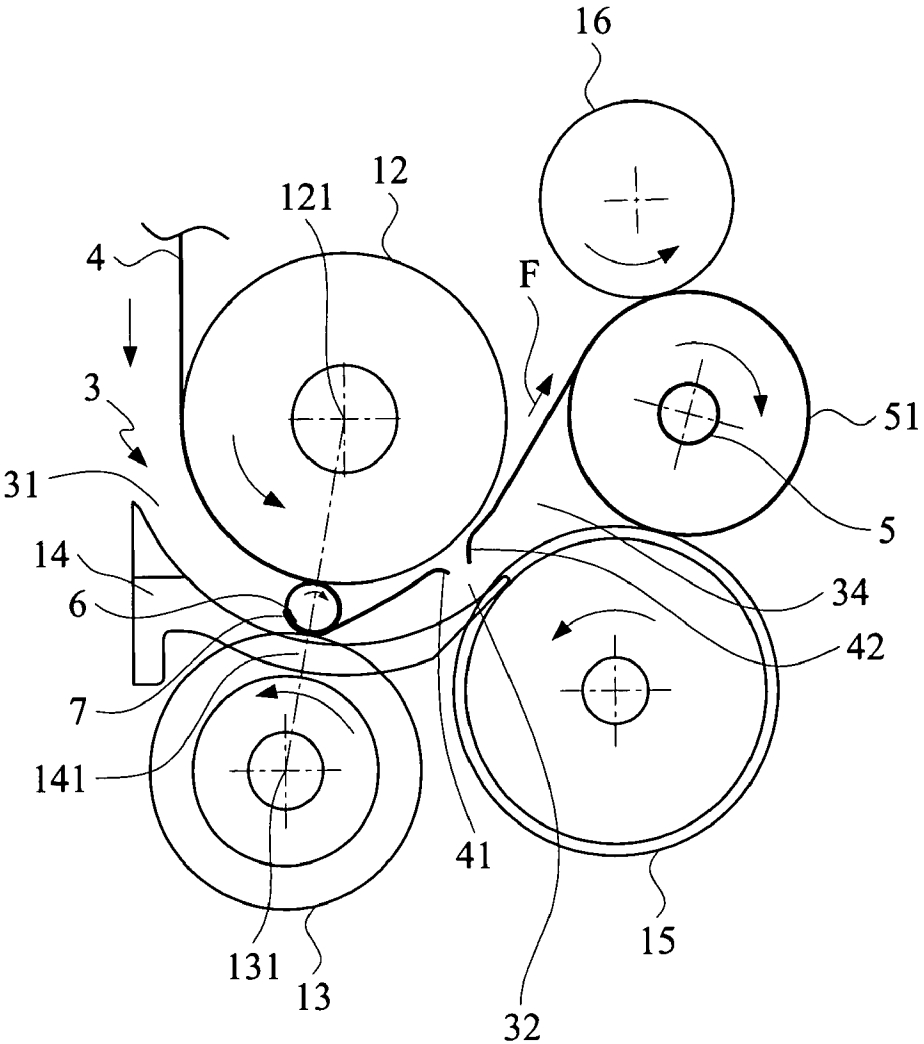
FIG. 6 shows that the tissue paper is pulled broken.

Please refer to FIGS. 5 and 6. When the second core 6 with the initial glue 7 is moved from the loading end 31 into the channel 3 and rolls to the narrowed passage 33 in the channel 3 between the first winding roller 12 and the circumferential surface of the pre-winding roller 13 protruded into the channel 3 (see FIGS. 1 to 4 for the position of the narrowed passage 33), the second core 6 would be temporarily held at the narrowed passage 33 due to a difference between the rotation speeds of the first winding roller 12 and the pre-winding roller 13. At this point, the tissue paper 4 is attached to the circumferential surface of the second core 6 by the initial glue 7 on the second core 6 and wound around the second core 6, and the tissue paper 4 wound around the second core 6 is clamped by and between the first winding roller 12 and the pre-winding roller 13. Moreover, since the rolled tissue 51 formed by the tissue paper 4 wound around the first core 5 is kept rotating and produce a pulling force F against the tissue paper 4, a section of the tissue paper 4 located between the first core 5 and the second core 6 is pulled broken at one of the line of perforations at the tissue paper 4 to thereby form a leading edge 41, which is then wound around the circumferential surface of the second core 6, and a trailing edge 42, which is then wound around the roller tissue 51 to complete the winding thereof.

Figure 7:
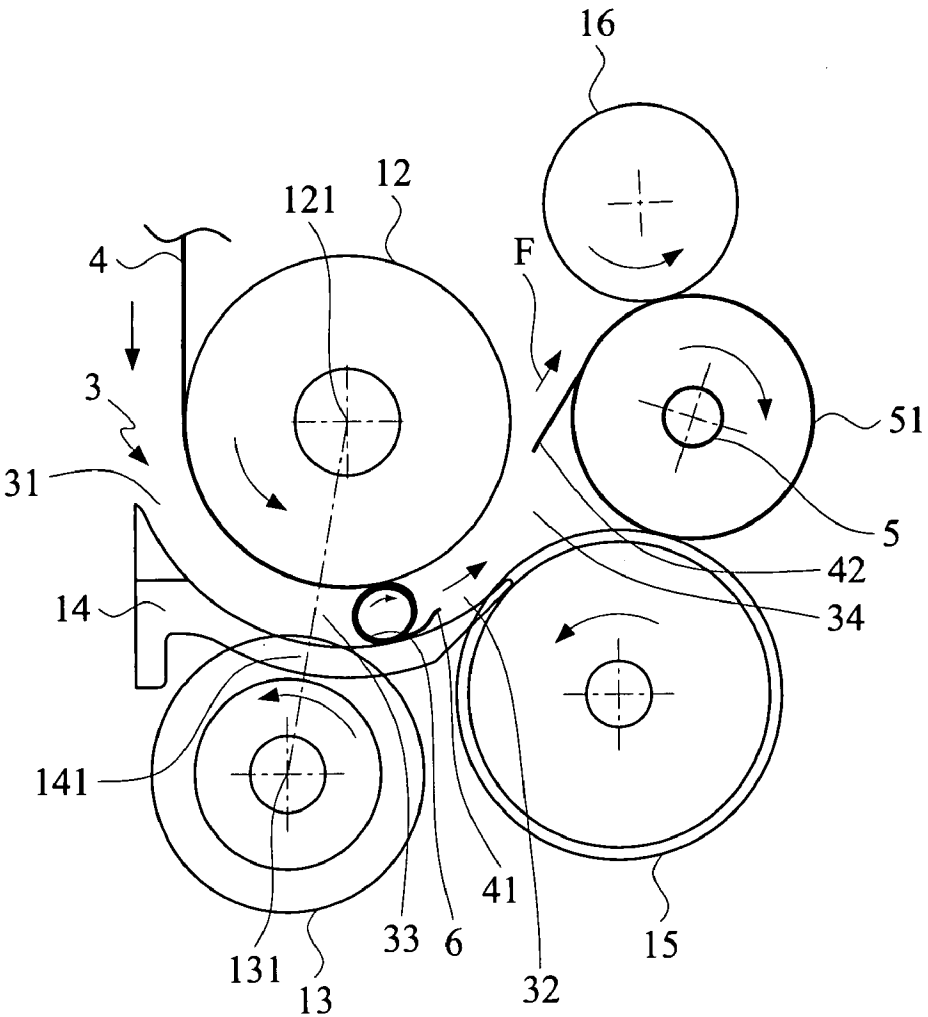
FIG. 7 shows that the second core has passed the narrow passage between the first winding roller and the circumferential surface of the pre-winding roller protruded into the channel and keeps rolling forward.

Please refer to FIG. 7. When the second core 6 is temporarily held at the narrowed passage 33, the first winding roller 12 rotated at a faster rotation speed than that of the prewinding roller 13 would finally drive the second core 6 to pass the narrowed passage 33 and keep rolling forward.

Figure 8:
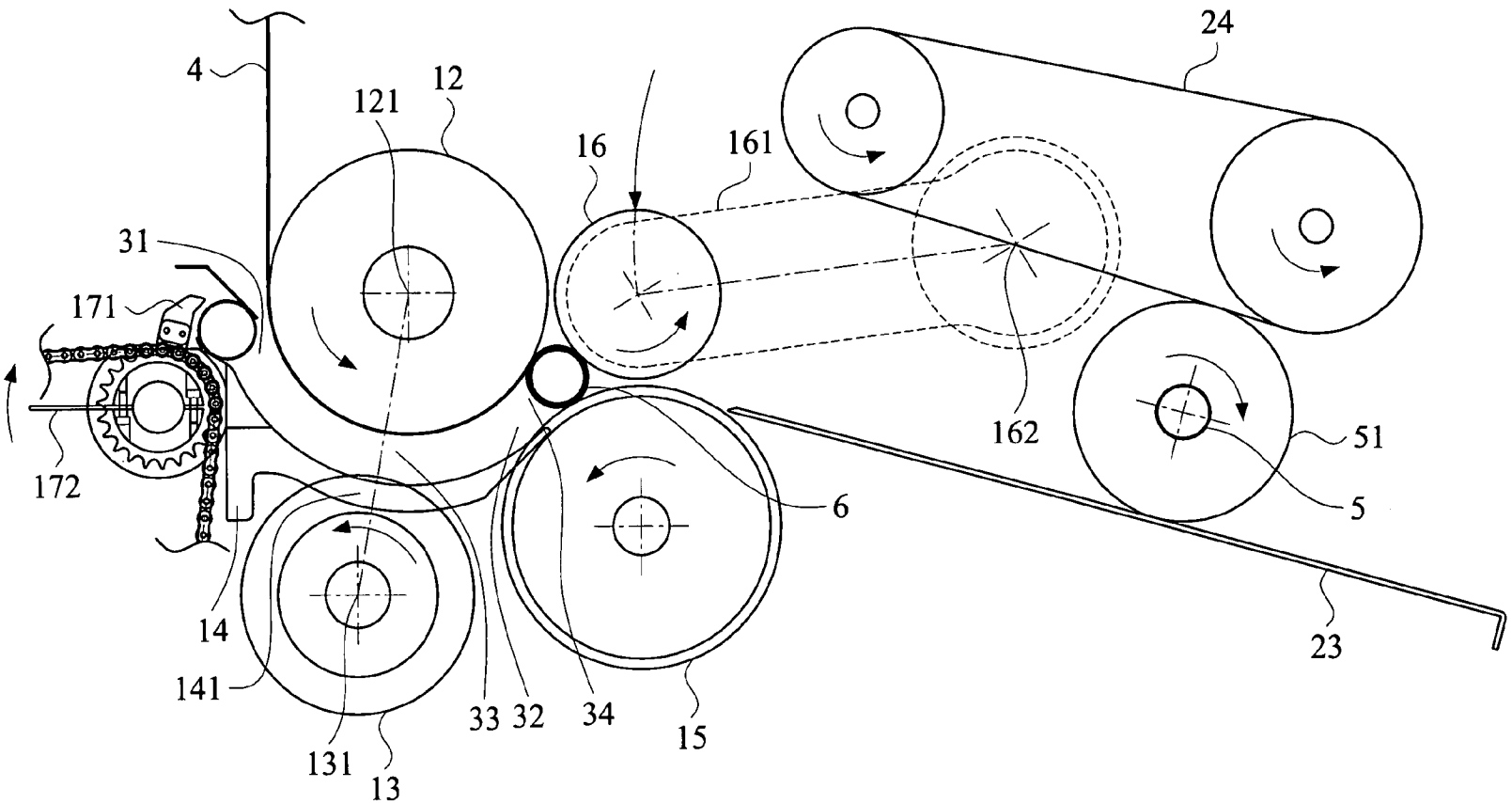
FIG. 8 shows that the second core moves to a winding area while a completed rolled paper formed on a first core is delivered out of the tissue paper winding and cutting machine.

As can be seen from FIG. 8, the second core 6 is delivered to the winding area 34 due to an effect of speed difference between the first winding roller 12 and the second winding roller 15 caused by a speed reduction of the second winding roller 15, and the winding of the following tissue paper 4 around the second core 6 is started. Meanwhile, the completed rolled tissue 51 formed on the first core 5 is moved by the belt 24 to roll down along the chute 23 and be discharged from the tissue paper winding and cutting machine 100.

The rider roller 16 is connected to an oscillable gripping arm 161. When the oscillable gripping arm 161 is oscillated about a pivot shaft 162 thereof, the rider roller 16 connected to the oscillable gripping arm 161 is driven to move upward and downward along an oscillating path of the oscillable gripping arm 161. Please refer to FIG. 8. When the rolled tissue 51 has been discharged along and between the chute 23 and the belt 24, the rider roller 16 initially pressed against the rolled tissue 51 would move downward to press against the second core 6.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A tissue paper winding and cutting machine, comprising:

a first winding roller;

at least one core support plate arranged in a vicinity of the first winding roller, such that a channel having a loading end and an output end is formed between the first winding roller and the at least one core support plate, allowing a long strip of a tissue paper to pass through the loading end to bear against a lower half circumferential surface of the first winding roller and be wound in a predetermined direction around a first core in a winding area near to the output end of the channel; and a pre-winding roller arranged below and in the vicinity of the first winding roller with a circumferential surface of the pre-winding roller facing toward the first winding roller and protruding into the channel formed between the first winding roller and the at least one core support plate, so that a narrowed passage is formed in the channel between the first winding roller and the protruded circumferential surface of the pre-winding roller; and the pre-winding roller having a shaft, about which the pre-winding roller rotates in a direction opposite to the predetermined moving direction of the tissue paper at a rotation speed slower than that of the first winding roller;

whereby when a second core having a length of glue applied thereto is driven to move from the loading end into the channel and roll to the narrowed passage in the channel, the second core is temporarily held at the narrowed passage due to a difference between the rotation speeds of the first winding roller and the pre-winding roller, contacts the tissue paper which is attached to the glue on the second core and winds around the circumferential surface of the second core while being clamped by and between the first winding roller and the pre-winding roller, and a section of the tissue paper located between the first core and the second core is pulled broken by a pulling force produced by a rolled tissue wound around the first core that keeps rotating while the second core is held at the narrowed passage.

2. The tissue paper winding and cutting machine as claimed in claim 1, further comprising a conveyer for moving the first core and the second core into the channel.

3. The tissue paper winding and cutting machine as claimed in claim 1, further comprising a gluing unit arranged at a predetermined position near the conveyer for applying an amount of glue onto an outer circumferential surface of the cores.

4. The tissue paper winding and cutting machine as claimed in claim 1, further comprising a second winding roller and a rider roller, wherein the winding area is located between the first winding roller, the second winding roller, and the rider roller.

5. The tissue paper winding and cutting machine as claimed in claim 1, wherein the pre-winding roller is provided on the circumferential surface thereof with a plurality of axially spaced annular grooves, and the at least one core support plate has a middle section received in a corresponding one of the annular grooves on the pre-winding roller.

* * * * *